US005257898A

United States Patent [19]

Blume

[11] Patent Number: 5,257,898

[45] Date of Patent: Nov. 2, 1993

[54] INFEED APPARATUS FOR MULTI-LEVEL DELIVERY OF CONVOLUTELY WOUND LOGS

[75] Inventor: Joseph A. Blume, Green Bay, Wis.

[73] Assignee: Paper Converting Machine Company, Green Bay, Wis.

[21] Appl. No.: 746,243

[22] Filed: Aug. 15, 1991

[51] Int. Cl.[5] ..... B65G 29/02

[52] U.S. Cl. ..... 414/745.9; 414/223; 414/746.3; 414/911; 198/435; 198/441; 156/357

[58] Field of Search ..... 156/356, 357; 198/435, 198/441; 414/745.9, 746.3, 746.4, 904, 906, 911, 223, 224

[56] References Cited

U.S. PATENT DOCUMENTS

| | | | |
|---|---|---|---|
| 1,300,010 | 4/1919 | Porter | 198/441 |
| 3,098,552 | 6/1963 | Schulz | 198/441 X |
| 3,717,239 | 2/1973 | Carter | 198/441 X |
| 3,757,927 | 9/1973 | Gable et al. | 414/746.3 X |
| 4,033,447 | 6/1977 | Heier | 198/441 |

FOREIGN PATENT DOCUMENTS

| | | | |
|---|---|---|---|
| 0106167 | 4/1984 | European Pat. Off. | 156/357 |
| 2061234 | 5/1981 | United Kingdom | 156/356 |

*Primary Examiner*—Michael S. Huppert
*Assistant Examiner*—Stephen T. Gordon
*Attorney, Agent, or Firm*—Tilton, Fallon, Lungmus & Chestnut

[57] ABSTRACT

Infeed apparatus for multi-level delivery of convolutely wound logs which includes a plurality of log supporting wheels rigidly mounted on a cross shaft with each of the wheels having a periphery interrupted by a plurality circumferentially spaced inwardly extending pockets, alternate of the pockets being constructed for upper level delivery and the remaining for lower level delivery, each of the pockets having a trailing rear wall extending radially outward and a forwardly extending flat wall, the lower level pockets additionally having a generally radially extending forward, leading wall.

1 Claim, 4 Drawing Sheets

INFEED APPARATUS FOR MULTI-LEVEL DELIVERY OF CONVOLUTELY WOUND LOGS

BACKGROUND AND SUMMARY OF INVENTION

This invention relates to infeed apparatus for multi-level delivery of convolutely wound logs and, more particularly, to apparatus used in the converting of paper webs and the like into wound rolls for further processing.

In particular, the invention has to do with the converting industry where webs of paper are wound into retail size rolls such as toilet tissue and kitchen toweling. A web from a jumbo size roll which may be six to eight feet in diameter and five to ten feet long is wound into a log. Subsequently the log is transversely cut to provide the well-known retail size rolls, viz., 4½ long for toilet tissue and 11" long for toweling. Incident to this processing, it has been found advantageous to provide multi-high delivery to such receivers as infeeds for log saws, accumulators and tail sealers. The instant invention is described in conjunction with a tail sealer apparatus inasmuch as contemporary tail sealers have difficulty in keeping up with the speed of the rewinders. For example, in-line tail sealers have difficulty in accepting upwards of 25–30 logs per minute—an easily attainable production rate in high speed rewinders. Although attempts have been made in the past to utilize two-high delivery systems for logs, they have been complicated and do not always perform reliably. With the instant invention, the illustrated two-high delivery apparatus easily accommodates 40 logs per minute.

The invention features in log delivery apparatus, a plurality of log-supporting wheels mounted on a in axially spaced relation. Each of the wheels includes a disc-like member having a periphery interrupted by an even number of circumferentially spaced pockets arranged in a number of groups so that alternate ones of the pockets or recesses are constructed for upper level delivery with the remaining recesses being constructed for lower level delivery. The contour of the pockets is different for the upper and lower level deliveries which provides a number of advantages over conventional chains or diverter gates. The lower level pockets are deeper, i.e., extend further radially inwardly so that logs positioned therein do not exit on the ramp leading to the upper receiver. Significant is continuous rotary motion which means very few moving parts resulting in less maintenance. The one wheel geometry handles a wide range of log diameters and the motion is slow and gentle—minimizing damage to logs. Still further, the wheel pick up and drop off are positive stripping points so as to minimize jamming.

Other objects and advantages of the invention may be seen in the details of the ensuing specification.

BRIEF DESCRIPTION OF DRAWINGS

The invention is described in conjunction with an illustrative embodiment in the accompanying drawing, in which—

DETAILED DESCRIPTION

Figure 1:
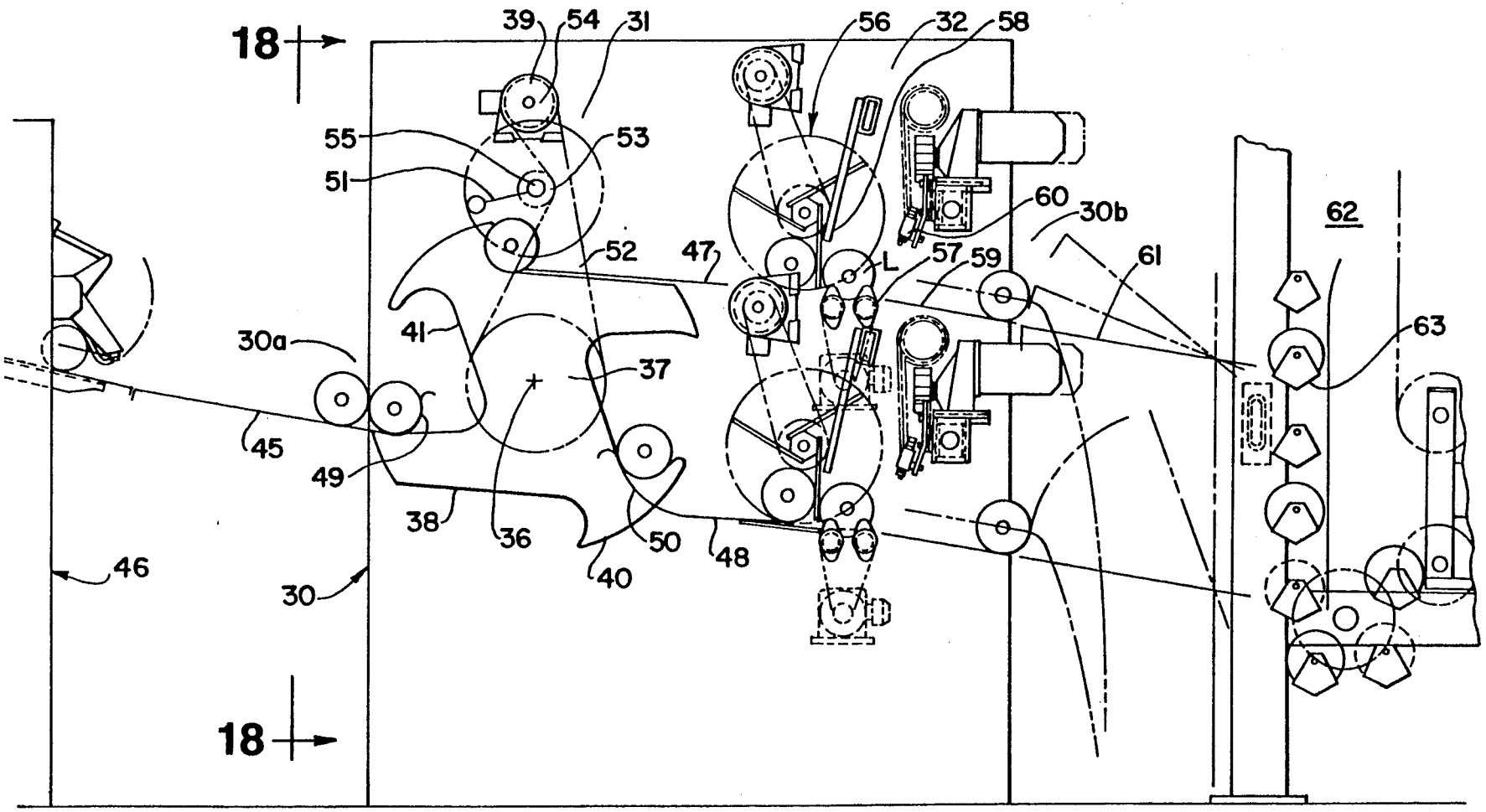
FIG. 1 is a side elevational view of the log delivery apparatus of the invention featured in conjunction with a tail sealer.

In the illustration given and with reference first to FIG. 1, the numeral 30 designates generally the frame of the apparatus which includes both the two level log delivery portion 31 and the tail sealing portion 32. The frame 30 includes a pair of side frames 33 and 34—see FIG. 18. The frame defines a log entering end **30*a* and a log delivery end 30*b***.

Figure 18:
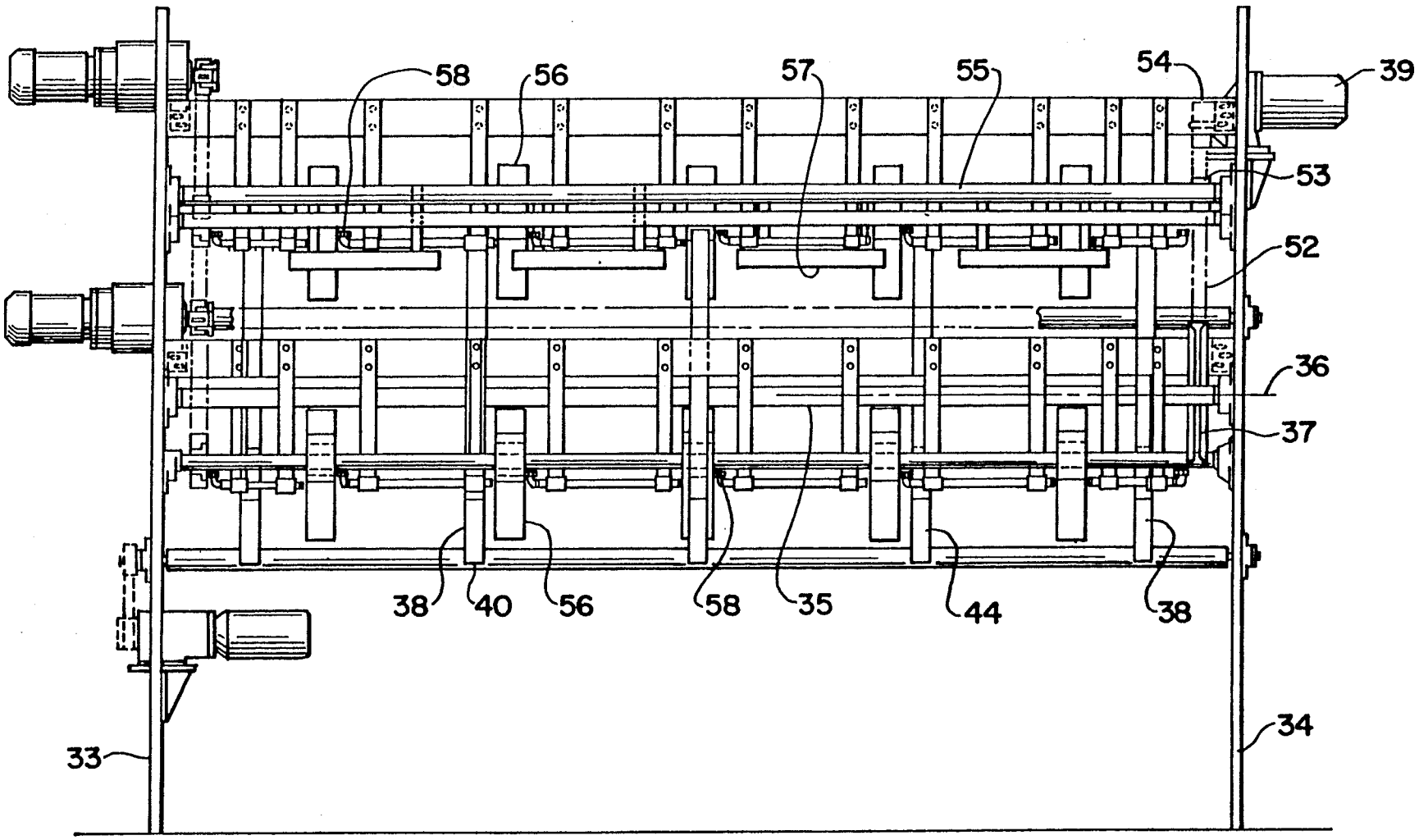
FIG. 18 is a fragmentary end elevational view such as would be essentially seen along the sight line 18—18 of FIG. 1.

Referring to FIG. 18, the frame rotatably supports a transverse shaft 35 which has an axis of rotation 36. The axis of rotation is also seen in FIG. 1. The shaft 35 at one extended end carries a pulley 37 which is connected to an electric motor 39 which constitutes means for rotating the shaft 35 and wheels 38.

The shaft 35 carries a plurality of log supporting wheels 38 in axially spaced relation. Each of the wheels 38 includes a disc-like member having a periphery as at 40 interrupted by four circumferentially spaced log-receiving, radially inwardly-extending recesses or pockets as at 41, 42, 43 and 44 (see FIG. 17). These recesses or pockets are arranged in groups so that alternate ones are constructed for upper level delivery (as at 42 and 44) with the remaining two recesses being constructed for lower level delivery, viz., those at 41 and 43.

Infeed means as at 45 are provided between the winder 46 and the frame 30 (see the left hand portion of FIG. 1) for introducing logs sequentially to the wheels 38.

On the downstream side, the frame 30 is equipped with vertically spaced upper and lower ramp means as at 47 and 48, respectively for accepting logs after the two level separation effected by the wheels 38.

Advantageously, barrier means as at 49 (see the left hand portion of frame 30 in FIG. 1) are provided adjacent the log introducing means 45 for limiting the entry of logs into the various recesses or pockets 41–44 to one log per recess.

On the downstream side, I provide stripper means as at 50 (see the lower central portion of FIG. 1) associated with the lower ramp means 48 for urging a log out of the lower level pockets 41, 43. The stripper means 50 are advantageously aligned with the barrier means 49 and are positioned between the wheels 38. I have found it advantageous to space the wheels axially apart about 18".

OPERATION

Figure 2:
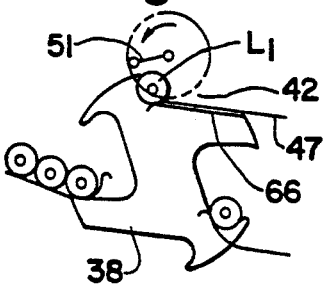
FIGS. 2–16 are schematic side elevational views showing different stages of the operation of the inventive wheels.

The operation of the invention can be appreciated from the sequence drawings of FIGS. 2–16. In FIG. 2 a log $L_1$ is in pocket 42 adjacent the zenith of the path of rotation of the wheel 38. It is now positioned for delivery along the upper ramp means 47 and I have found it advantageous to provide acceleration means in the form of a rotating arm 51 which is synchronized via the drive 52 (see FIGS. 1 and 18) with the rotation of the shaft 35 and therefore the wheels 38.

Figure 3:
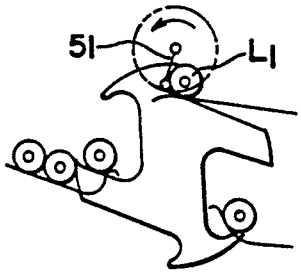

In FIG. 3, the arm 51 is seen urging the log $L_1$ to the right for further processing—such as accumulator infeed, log saw infeed or, as illustrated, to a tail sealer.

In the illustration given, the arm or accelerating member 51 makes one revolution for each pocket or recess on the wheels 38 and this can be appreciated from the fact that the belt drive (see the upper central portion of FIG. 1) interconnects the shaft 35 with the arm 51. More particularly, the shaft 35 carries a large diameter pulley 37 which is coupled via belt 52 to a smaller pulley 53 associated with the arm 51 and the drive pulley 54 associated with the motor 39. The pulley 53 is mounted on a cross shaft 55.

Figure 4:
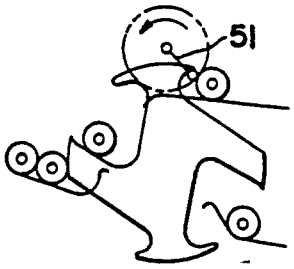
Figure 5:
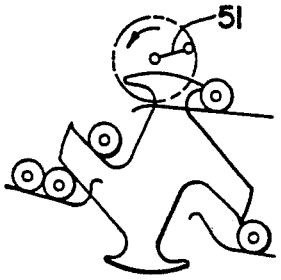
Figure 6:
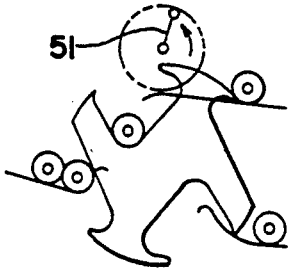
Figure 7:
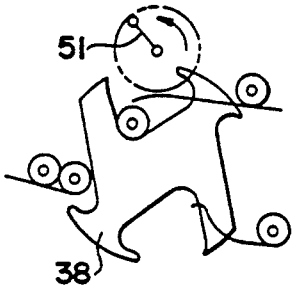
Figure 8:
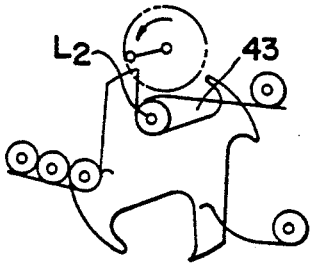
Figure 9:
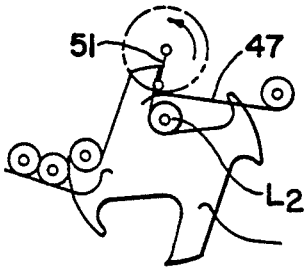
Figure 10:
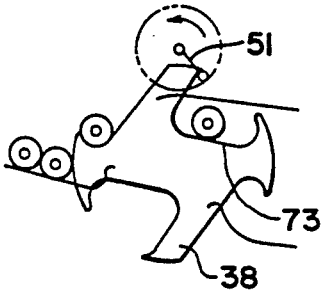
Figure 11:
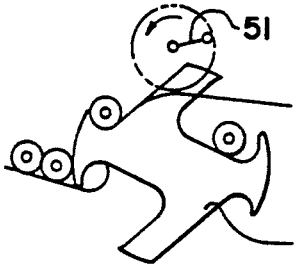
Figure 12:
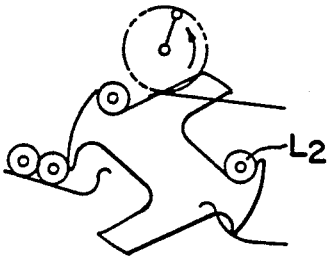
Figure 13:
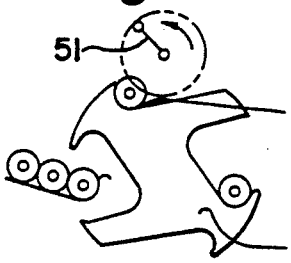

Referring to the sequence views, FIG. 4 depicts the condition of the apparatus a short time after that pictured in FIG. 3—as may be quickly appreciated from the position of the accelerating arm 51. FIGS. 5, 6 and 7 show the condition of the apparatus during the subsequent rotation of both the arm 51 and the wheels 38. When the apparatus reaches the condition illustrated in FIG. 8, the pocket 43 is now adjacent the zenith of the wheel rotation and carries a log $L_2$. The pocket 43 can be seen to be deeper, i.e., extending further radially inward, than the pocket 42 so that as seen in FIG. 9, the arm 51 passes over both the log $L_2$ and the upper ramp means 47.

Figure 14:
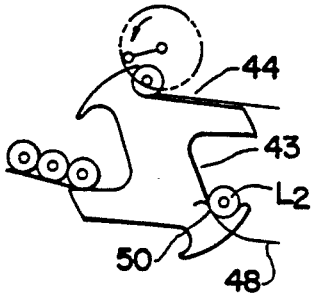
Figure 15:
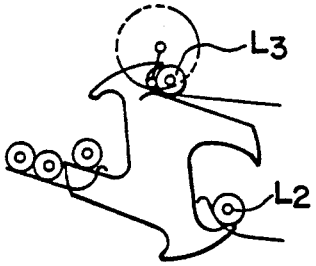
Figure 16:
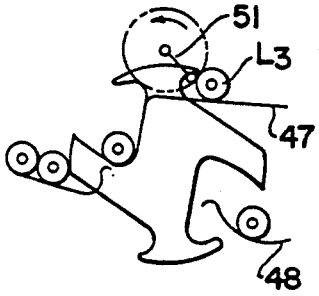

In FIGS. 10–13, the wheels 38 and arm 51 are seen in successive positions and by the time the apparatus reaches the showing in FIG. 14 another upper level pocket 44 is adjacent the wheel zenith and, as seen in FIG. 15, the log $L_3$ is being engaged by the arm 51 to accelerate the same.

Meanwhile, as seen in FIG. 14, the log $L_2$ is being stripped by the stripper means 50 from the pocket 43 for delivery along the lower ramp means 48. Then, in FIG. 16, the log $L_3$ is being propelled by the arm 51 along the upper ramp means 47.

From the foregoing, it will be seen that the significant movements are all rotational and with a minimum of likelihood for jamming or otherwise damaging the logs.

TAIL SEALER

Reference is made again to FIG. 1 and the tail sealer will be described in conjunction with the upper level delivery—it being understood that the same type of tail sealing mechanism is used for the lower level delivery.

In the upper right hand portion of FIG. 1, the ramp means delivers logs which are indexed by a paddle wheel mechanism generally designated 56. The mechanism 56 insures that only a given log L will be engaged by a cradle of rotating rolls 57. Incident to the log L being rotated by the cradle rolls 57, a series of air jets 58 unwinds the tail of the log for positioning on a platform 59. At this point in time a traversing nozzle 60 lays down a transverse ribbon of adhesive on the tail after which the continued operation of the paddle wheel 56 moves the log L down the platform 59 whereby the rolling action of the log rewinds the tail and seals it to the main body of the log.

A further ramp or incline as at 61 is provided for the now tail-sealed roll to enter the accumulator 62 (see the upper right hand portion of FIG. 1). The accumulator features a series of supports as at 63 which carry individual logs for storage until delivery to a log saw (not shown) is required. As can be appreciated from the depiction in FIG. 1, a log from the upper level enters every other support 63 with logs from the lower level filling the alternate supports. In each case, the ramp 61 can be pivoted upon an appropriate signal to cause the log to be culled, i.e., be diverted from entering the accumulator 62. This occurs when a log has been damaged and is in accordance with standard operating procedure in converting operations.

WHEEL POCKET CONTOUR

Figure 17:
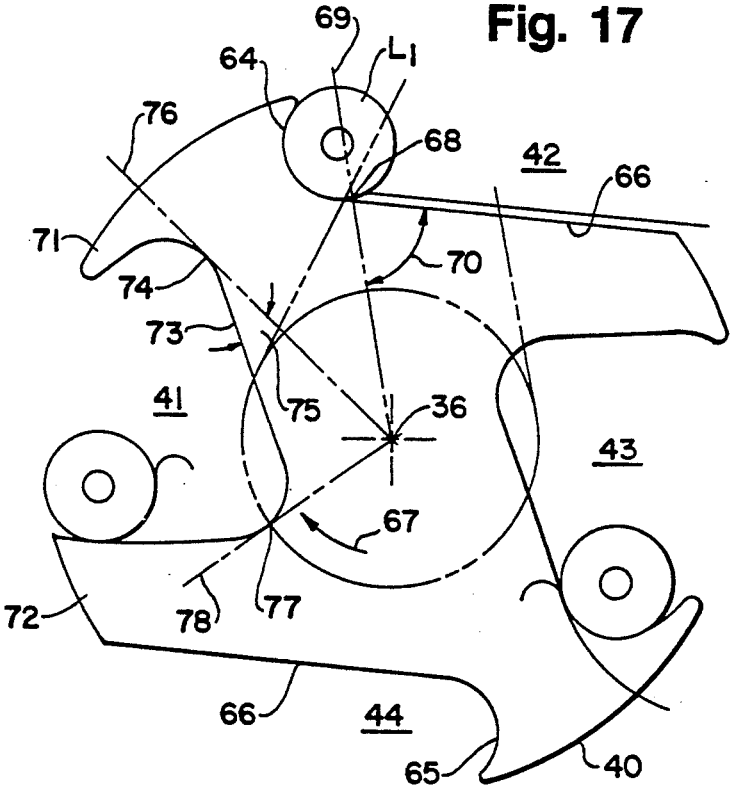
FIG. 17 is an enlarged fragmentary side elevational view of the wheel portion of the invention.

As indicated previously, the recesses or pockets for the upper and lower deliveries have different contours. Generally speaking, the lower delivery pockets are deeper so as to enable the logs contained therein to pass by the upper delivery ramp means 47. The contours specific to each of these two types of pockets will now be explained in conjunction with FIG. 17. In FIG. 17 the upper level recesses 42, 44 have essentially a "sled runner" shaped contour as is best appreciated from the portion designated 64. More particularly, the overall contour 64 includes a generally C-shaped portion 65 (see the lower portion of FIG. 17 relative to the recess 44) which merges into a straight portion 66. As can be appreciated from the upper part of FIG. 17, it is the straight portion 66 which is first encountered in the direction of rotation of the wheels 38—the direction of rotation being indicated by the arrow 67.

The upper level pocket contour 64 can be characterized as having a point of member 68 between the C-shaped portion 65 and the straight portion 66. In FIG. 17 a construction line 69 representing a radial line from the axis 36 to the point of merger 68 defines a major acute angle 70 with the straight portion 66. In practice, when the log $L_1$ is about at the zenith of its movement along with the wheel 38, the straight or flat portion 66 is almost horizontal and preferably two to three degrees inclined down from the horizontal in proceeding from left to right. This provides a slight gravitational component to the log $L_1$. However, I prefer to employ the accelerating arm 51 to insure more rapid movement of the log $L_1$ into the tail seal cradle rolls 57.

Each of the lower level recesses 41, 43 has a generally C-shaped contour overall including a pair of circumferentially spaced arm portions 71, 72 (see the left hand portion of FIG. 17) connected by and merging into a straight bight portion 73. The bight portion 73 at the point of merger 74 with the leading arm or wall portion 71 is disposed at a minor acute angle 75 to a radial construction line 76 from the shaft axis 36

The bight portion 73 at the point of merger 77 with the trailing arm portion 72 is disposed generally perpendicularly to a radial construction line 78 from the shaft axis 36.

Thus, both sets of pockets 41, 43 for the lower level, and 42, 44 for the upper level include a generally radially extending rear wall as at 72 and 65, respectively and a generally flat wall 73, 66 extending forwardly in the direction of rotation from the associated rear wall. The flat wall 66, 73 is disposed generally horizontally when its associated pocket is adjacent the zenith of wheel rotation (compare FIGS. 2 and 10).

The lower level pockets differ from the upper level pockets in being equipped further with a generally radially extending forward wall as at 71 which is leading in the direction of wheel rotation. This serves to prevent discharge of the log $L_2$ (see FIG. 12) until the same is engaged by the stripper means 50 (see FIGS. 14–15).

It will be appreciated that the invention is adapted to provide a plurality of multi-level deliveries: two high, three high, etc. as well as having a varying number of pockets—as long as the pockets in each group are contoured for successive delivery of logs to a plurality of vertically arranged ramp means.

While in the foregoing specification a detailed description of an embodiment of the invention has been set down for the purpose of illustration, many variations in the details hereingiven may be made by those skilled in the art without departing from the spirit and scope of the invention.

I claim:

1. Infeed apparatus for two level delivery of convolutely wound logs comprising a frame including horizontally-spaced apart subframes, defining a log entering end and a log delivery end, a horizontally-extending shaft rotatably mounted on said frame and journaled in said subframes, means operably associated with said frame for rotating said shaft in a given direction, a plurality of log-supporting wheels rigidly mounted on said shaft in axially-spaced relation and having a zenith of rotation, said wheels being spaced sufficiently to support a 5' to 10' log, each of said wheels including a disc-like member having a periphery interrupted by four circumferentially spaced log-receiving, radially inwardly-extending pockets arranged so that a first and third of said pockets are constructed for upper level delivery with the second and fourth of said pockets being constructed for lower level delivery, means operably associated with said frame entering end for introducing logs sequentially to said wheels, vertically spaced upper and lower ramp means operably associated with said frame delivery end, barrier means operably associated with said frame adjacent said log introducing means for limiting the entry of logs into said pockets to one log per pocket, tail sealing means being operably associated with each ramp means, each pocket including a generally radially extending rear wall trailing in the direction of wheel rotation and a generally flat wall extending forwardly from said rear wall, each said flat wall being disposed generally horizontally when its associated pocket is adjacent the zenith of wheel rotation, the lower level pockets being equipped with a generally radial extending forward wall leading in the direction of roll rotation, and stripper means operably associated with said lower ramp means for urging a log over said forward wall, said generally flat wall of each of said lower level pockets after passing said density promoting rolling of a log toward said forward wall whereby a log is spaced from said lower level pocket rear wall upon engagement with said stripper means.

* * * * *